US005465196A

United States Patent [19]

Hasenberg et al.

[11] Patent Number: 5,465,196

[45] Date of Patent: Nov. 7, 1995

[54] PORTABLE CORDLESS ELECTRIC UTILITY LAMP

[75] Inventors: Mark J. Hasenberg, Kenosha, Wis.; Peter B. Rau, Danville, Ill.

[73] Assignee: Snap-on Incorporated, Kenosha, Wis.

[21] Appl. No.: 265,229

[22] Filed: Jun. 24, 1994

Related U.S. Application Data

[63] Continuation-in-part of Ser. No. 984,964, Dec. 3, 1992, abandoned.

[51] Int. Cl.[6] ..... F21L 7/00

[52] U.S. Cl. ..... 362/183; 362/396; 362/223; 362/275; 362/285

[58] Field of Search ..... 362/369, 396, 362/399, 401, 374, 377, 223, 220, 183, 184, 200, 275, 285; 429/97

[56] References Cited

U.S. PATENT DOCUMENTS

| | | | |
|---|---|---|---|
| 2,691,092 | 10/1954 | McConnell et al. | 362/223 |
| 2,807,710 | 9/1957 | Williams | 362/223 |
| 2,963,573 | 12/1960 | Ziegenbein | 362/183 |
| 3,331,958 | 7/1967 | Adler . | |
| 3,767,904 | 10/1973 | Cook . | |
| 4,156,893 | 5/1979 | Baake . | |
| 4,249,234 | 2/1981 | Park et al. . | |
| 4,262,327 | 4/1981 | Kovacik et al. | 362/396 |
| 4,268,894 | 5/1981 | Bartunek et al. . | |
| 4,321,657 | 3/1982 | Hoi . | |
| 4,432,043 | 2/1984 | Yuen . | |
| 4,535,397 | 8/1985 | May | 362/376 |
| 4,782,432 | 11/1988 | Coffman . | |
| 4,958,267 | 9/1990 | Baake . | |
| 4,977,489 | 12/1990 | Fung . | |
| 5,170,332 | 12/1992 | Browne | 362/376 |
| 5,203,624 | 4/1993 | Schier et al. | 362/183 |
| 5,213,913 | 5/1993 | Anthony, III et al. | 429/97 |
| 5,217,297 | 6/1993 | Yuen | 362/183 |
| 5,243,505 | 9/1993 | Carr | 362/396 |

FOREIGN PATENT DOCUMENTS

| | | | |
|---|---|---|---|
| 2208135 | 3/1989 | United Kingdom | 362/183 |

OTHER PUBLICATIONS

Operating instructions for and photographs of Panasonic EY 574 cordless tool using EY 970 battery pack (No date available).

Instruction Manual for Brinkmann Home/Guard Rechargeable Lamp.

Polaroid photographs of Alltrade, Inc. utility lamp.

Polaroid photographs of Rayovac Work Horse utility lamp.

*Primary Examiner*—James C. Yeung

*Attorney, Agent, or Firm*—Emrich & Dithmar

[57] ABSTRACT

A portable cordless electric utility lamp includes a base having two parts which mate in an assembled condition to define an elongated handle which has a hollow distal end portion receiving a rechargeable battery pack. An elongated light-transmitting tube fits telescopically between cylindrical wall portions and retaining structures on the base parts for holding them together, being affixed thereto by screws. An elongated fluorescent bulb is plugged into the base and disposed in the tube. A cap closes the distal end of the tube and has a foam rubber cushion which seats against the distal end of the bulb for supporting and cushioning it.

15 Claims, 2 Drawing Sheets

50
90
80
85
89
81
86
87
84
83
53
57
51
56
61
52
60
65

90
88
91
82
81
86
92
92
11
83
84
11
53
71
67
71A
67A
12
12
70
66
56
66A
70A
61
52
60
62
64
65

90
92
89
88
85
86
92
91
80
82
81
84
83
54
53
54

55
53
77
75
67
78
72
74
70
69
76
71
66
73

57
86
53
92
92
83

68
71
53
78
78
61
62
56
71A
57

74
67
77
76
66

PORTABLE CORDLESS ELECTRIC UTILITY LAMP

CROSS-REFERENCE TO RELATED APPLICATION

This is a continuation-in-part of U.S. application Ser. No. 984,964, filed Dec. 3, 1992, abandoned.

BACKGROUND OF THE INVENTION

1. Field of the Invention

The invention relates to electric lamps and, more particularly to portable utility lamps which are battery powered.

2. Description of the Prior Art

The standard electric utility lamp is AC-powered, having a long power cord adapted to be plugged into an associated source of household current. Since such utility lamps are limited to use where AC power is available, it is known to provide portable utility lamps which are battery-powered. Most such lamps utilize incandescent bulbs and are powered by a plurality of 1.5-volt "C" or "D" cells or one or more 6-volt lantern batteries. Such lamps have a limited battery life and the batteries must be periodically replaced at significant expense.

Since incandescent bulbs are relatively inefficient in converting electrical energy to light, it is known to provide utility lamps with fluorescent bulbs. But multiple batteries are still required to provide the high voltage necessary to power the ballast circuit needed by a fluorescent bulb. It is known to provide a built-in rechargeable battery in a portable electric lamp. While this obviates battery replacement, it requires that the entire lamp be periodically connected to a recharging circuit, and while it is thus connected, the lamp cannot be used.

Many prior lamps have provided a globe surrounding the bulb and mounted to an associated housing. In such lamps, replacement of the bulb has required removal of the globe, which has, in turn, required disassembly of the housing.

SUMMARY OF THE INVENTION

It is a general object of the invention to provide an improved cordless electric utility lamp which avoids the disadvantages of prior portable electric lamps while affording additional structural and operating advantages.

An important feature of the invention is the provision of a portable, cordless, electric utility lamp which is provided with a bulb-encircling globe and which facilitates bulb replacement.

In connection with the foregoing feature, a further feature of the invention is the provision of a lamp of the type set forth, in which the globe holds together the parts of a two-part housing.

A further feature of the invention is the provision of a utility lamp of the type set forth which is ergonomically designed and of simple and economical construction.

These and other features of the invention are attained by providing a portable cordless electric lamp comprising: a base including first and second parts cooperating in an assembled condition to define a handle portion, an elongated cylindrical tube formed of a light transmitting material and having opposite ends, receptacle structures respectively on the base parts, one end of the tube being received in both of the receptacle structures when the base parts are in the assembled condition for holding the base parts in the assembled condition, fastening structure securing the one end of the tube to each of the receptacle structures, an electric bulb mounted on the base and disposed within the tube for emitting light therefrom, and a battery carried by the base and coupled to the bulb.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
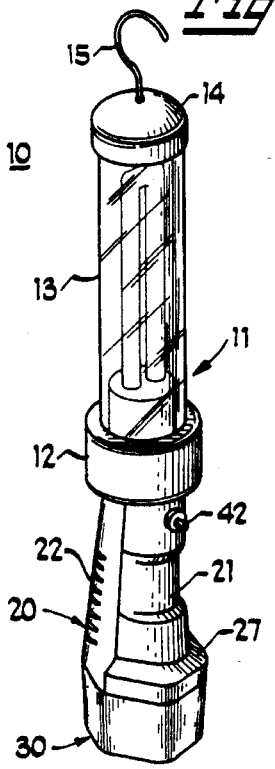
FIG. 1 is a perspective view of a utility lamp constructed in accordance with and embodying the features of the present invention.
Figure 2:
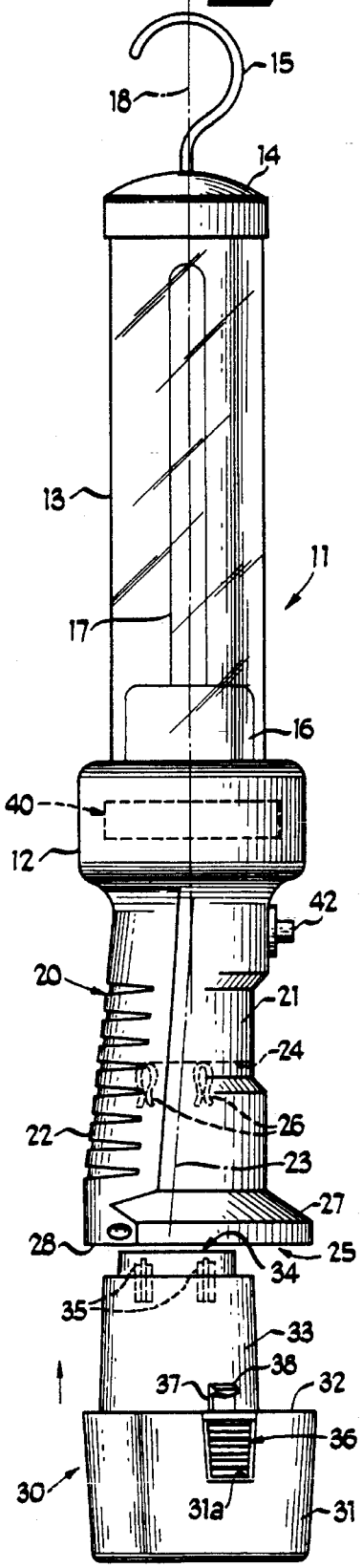
FIG. 2 is an enlarged, side elevational view of the lamp of FIG. 1, illustrating the battery pack separated from the lamp handle.
Figure 3:
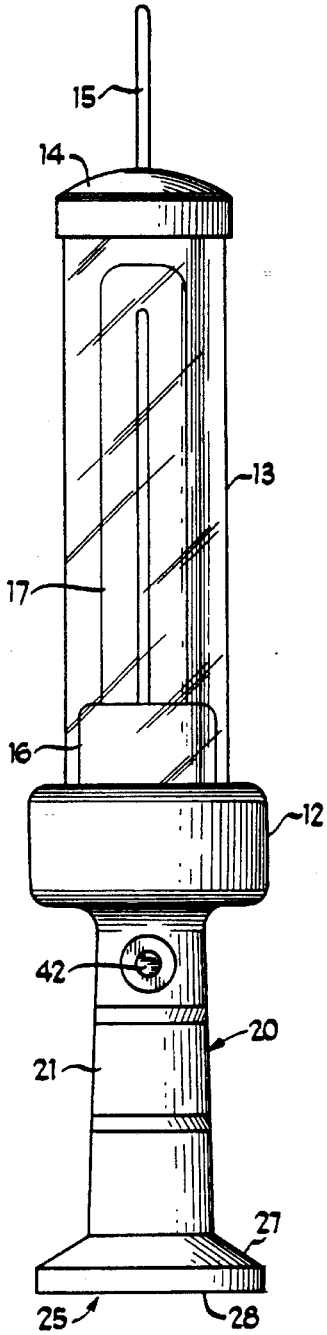
FIG. 3 is a side elevational view of the lamp of FIG. 2 as viewed from the right-hand side thereof, and with the battery pack removed.
Figure 4:
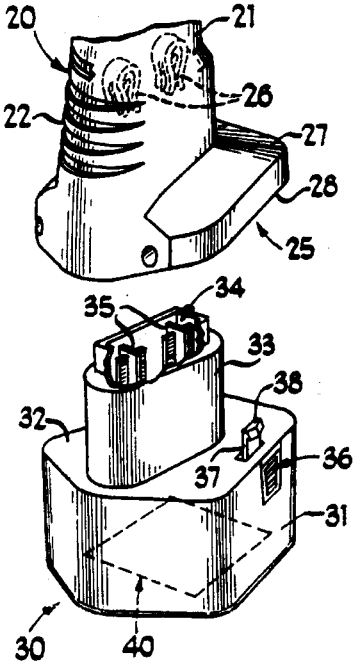
FIG. 4 is a fragmentary sectional view of portions of the handle and battery pack of the lamp of FIG. 1, illustrating electrical interconnection therebetween.

Referring to FIGS. 1–3, there is illustrated a utility lamp 10 constructed in accordance with and embodying the features of a first embodiment of the present invention. The lamp 10 has a housing 11 including a cylindrical base 12 and an elongated cylindrical tube 13 secured to the base 12 coaxially therewith by suitable means. The tube 13 is formed of a suitable light-transmitting material, such as transparent glass, plastic or the like. The tube 13 is closed at its distal end by a cap 14 on which is mounted an outwardly projecting hook 15 for hanging the lamp 10 in a known manner. The cap 14 may be secured to the tube 13 by any suitable means. Projecting upwardly into the tube 13 from the base 12 is a socket 16 for receiving the ends of an elongated, generally U-shaped fluorescent bulb 17 in electrical contact therewith. The housing 11 has a longitudinal axis 18.

Integral with the base 12 and projecting therefrom in the opposite direction from the tube 13 is a handle 20, which is preferably of two-part construction. More specifically, the handle 20 includes a front part 21, which is unitary with the base 12, and a rear part 22 which is adapted to be fixedly secured to the front part 21 by suitable fasteners (not shown). The handle 20 has a longitudinal axis 23 which is inclined at a predetermined small angle, preferably less than 15°, with respect to the axis 18 of the housing 11. The distal end of the handle 20 is hollow, having an inner end wall 24 for defining a hollow receptacle 25. Projecting into the receptacle 25 from the inner end wall 24 is a pair of contact prongs 26, each generally in the form of an inverted U-shaped member with out-turned bifurcated legs to defined a generally cruciform slot. The distal end of the handle 20 is provided with an outwardly flared skirt flange 27 which terminates in an end surface 28. Formed on the inside of the skirt flange 27, preferably on opposite sides of the handle 20, are two laterally inwardly projecting latch flanges 29 (one shown in FIG. 5).

The lamp 10 includes a rechargeable battery pack 30 which has an enlarged base 31 terminating in a top wall 32, from which extends an upwardly projecting post 33 having a recess 34 formed in the upper end thereof. Disposed in the recess 34 are a pair of contact prongs 35. The base 31 has a pair of apertures 31*a* formed in opposite sides thereof (one shown), in which are respectively disposed two identically constructed latch members 36, only one of which is illustrated. The latch member 36 has a hook 37 which projects upwardly through a complementary opening in the top wall 32 of the base 31 and terminates in a laterally outwardly extending lip 38. A leaf bias spring 39 is disposed in a complementary socket in the base 31 and resiliently urges the latch member 36 outwardly to a normal latching position, the latch member 36 being manually depressible against the urging of the bias spring 39 to a release position.

Figure 5:
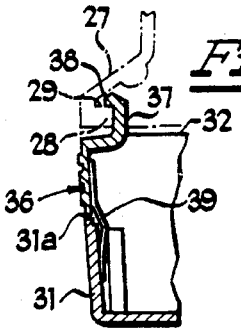
FIG. 5 is a fragmentary view in vertical section illustrating the latching of the battery pack to the handle.
Figure 6:
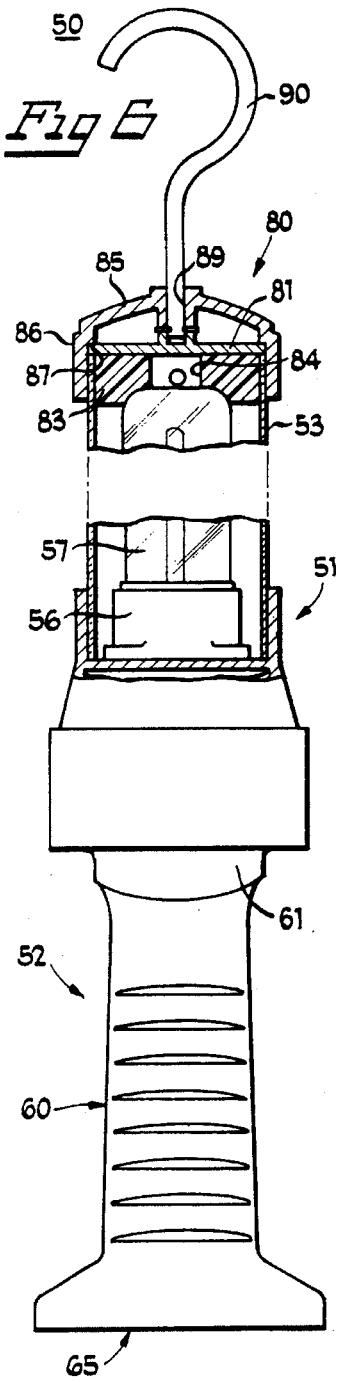
FIG. 6 is a rear elevational view in partial vertical section and with portions broken away of a lamp constructed in accordance with another embodiment of the invention.
Figure 7:
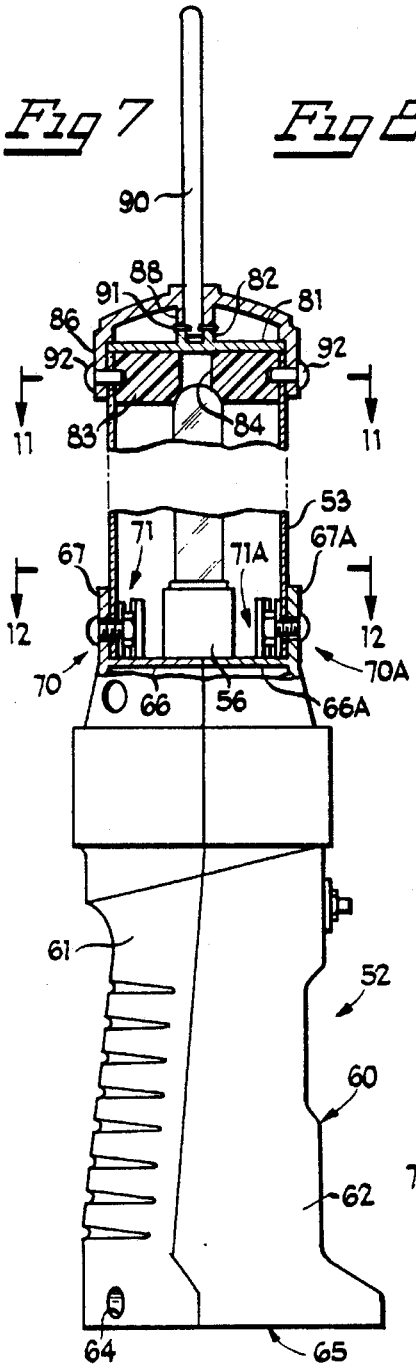
FIG. 7 is a side elevational view in partial vertical section and with portions broken away of the lamp of in FIG. 6.
Figure 8:
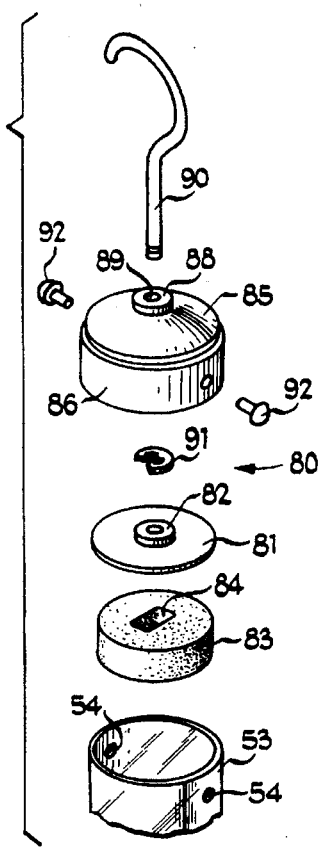
FIG. 8 is a reduced, fragmentary, exploded, perspective view of the cap assembly and the upper end of the globe of the lamp of FIG. 6.

In operation, the post 33 of the battery pack 30 is receivable in the receptacle 25 of the handle 20 in a mounted condition, illustrated in FIG. 1, wherein the top wall 32 of the battery pack 30 is disposed closely adjacent to the end surface 28 on the handle skirt flange 27 (see FIGS. 1 and 5). In this mounted condition, the contact prongs 35 of the battery pack 30 will engage and electrically contact the contact prongs 26 in the handle 20. For example, the prongs 35 may have a cruciform cross section and be received in cruciform slots in the prongs 26, in a known manner. As the battery pack 30 is moved to its mounted condition, in the direction illustrated by the arrow in FIG. 2, the lips 38 of the latch members 36 cam past the latch flanges 29 on the handle 20, resiliently tilting the latch members 36 to their release positions to permit the battery pack 30 to move to its mounted condition. The hooks 37 then snap back to their latching positions when the battery pack 30 has reached its mounted condition, bringing the lips 38 into latching engagement with the latch flanges 29, as illustrated in FIG. 5, and securely holding the battery pack 30 in place in the handle 20. When it is desired to remove the battery pack 30, the latch members 36 are manually depressed to release the latches. The battery pack 30 and the latching arrangement for latching it to the handle 20 may be of the type disclosed in copending U.S. application Ser. No. 838,901, filed Feb. 21, 1992 and entitled "Latching Arrangement for Battery Pack", the disclosure of which is incorporated herein by reference.

The housing 11 contains a suitable ballast circuit 40 (FIG. 2), which is electrically connected to the socket 16 and to the contact prongs 26, for powering the fluorescent bulb 17 in a known manner. The ballast circuit 40 may include a push-button switch 42 projecting forwardly from the handle 20 for selectively energizing the bulb 17.

It is a significant feature of the invention that the inclination of the handle axis 23 with respect to the housing axis 18 provides an ergonomic design which minimizes strain on the wrist of a user when the lamp 10 must be hand-held for extended periods of time. While the lamp 10 is disclosed as provided with a clear, light-transmitting tube 13 which will provide illumination through 360° around the axis 18, it will be appreciated that a suitable reflector could be provided within the tube 13 to direct illumination from the lamp 10 in a particular direction.

Another significant advantage of the invention is that the detachable battery pack 30 obviates battery replacement and permits recharging of the battery pack without the need for moving the entire lamp 10 to the recharging circuit. Thus, for example, by the provision of two battery packs 30, the lamp 10 could remain in service while one battery pack is being recharged.

Referring to FIGS. 6–10, there is illustrated a utility lamp 50 constructed in accordance with another embodiment of the present invention. The lamp 50 is similar in construction to the lamp 10 described above, and has a housing 51 including a base 52 and an elongated cylindrical tube or globe 53 secured by suitable means to the base 52 coaxially therewith. The tube 53 is substantially the same as the tube 13, described above, except that it includes a pair of diametrically opposed holes 54 formed radially therethrough adjacent to the upper end thereof and a pair of diametrically opposed holes 55 formed radially therethrough adjacent to the lower end thereof (one shown in FIG. 9). Projecting upwardly into the tube 53 from the base 52 is a socket 56 for receiving the ends of an elongated, generally U-shaped fluorescent bulb 57 in electrical contact therewith, in the same manner as was described above in connection with the socket 16 and the bulb 17.

The base 52 includes a handle 60 projecting in the opposite direction from the tube 53. The entire base 52 is preferably of two-part construction, including a rear part 61 and a front part 62. Formed in the rear part 61 adjacent to the lower end thereof are a pair of holes 64 (one shown in FIG. 7) for receiving suitable fasteners for threaded engagement with coupling blocks (not shown) within the front part 62 for fixedly securing together the front and rear parts 62 at their lower ends. The lower end of the handle 60 is hollow and defines a receptacle 65 for receiving therein the battery pack 30, in the same manner described above in connection with the lamp 10.

The rear and front parts 61 and 62 of the base 52 are, respectively, provided at their upper ends with generally semi-circular end walls 66 and 66A and semi-cylindrical wall portions 67 and 67A. When the rear and front parts 61 and 62 are assembled together to form the base 52, the end wall portions 66 and 66A cooperate to form a circular end wall, while the semi-cylindrical wall portions 67 and 67A cooperate to define a cylindrical wall 68. Formed respectively radially through the cylindrical wall 68 at diametrically opposed locations are holes 69 (one shown in FIG. 9).

Figure 9:
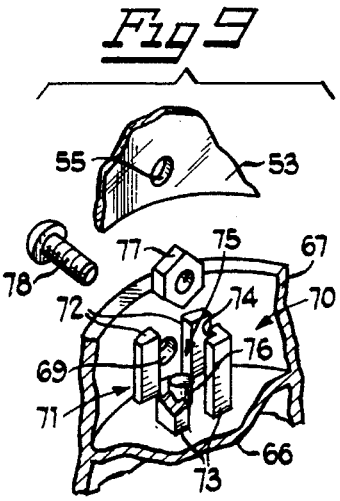
FIG. 9 is an enlarged, fragmentary, exploded view in partial section of the coupling between the globe and the base of the lamp of FIG. 6.
Figure 11:
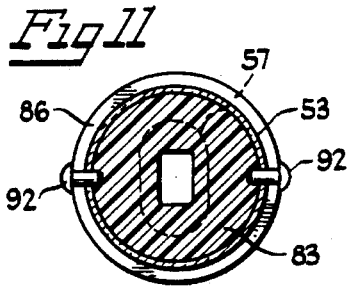
FIG. 11 is a view in horizontal section taken along the line 11—11 in FIG. 7.
Figure 10:
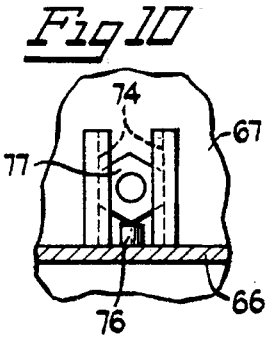
FIG. 10 is a fragmentary, side elevational view of the coupling of FIG. 9, as viewed from the inside thereof.

The semi-cylindrical wall portions 67 and 67A respectively form portions of coupling structures 70 and 70A, respectively on the rear and front parts 61 and 62. The coupling structures 70 and 70A are of substantially identical construction, wherefore only one will be described in detail. Referring to FIGS. 9 and 10 the coupling structure 70 includes a retaining standoff 71 spaced radially inwardly of the cylindrical wall 68. More specifically the retaining standoff 71 includes a pair of outer posts 72 spaced a slight distance radially inwardly of the cylindrical wall 68 and a pair of inner posts 73 spaced a slight distance further inwardly from the outer posts 72. Each of the inner posts 73 is provided in its outer edge with an elongated groove 74. The posts 72 and 73 cooperate to define a pocket 75, in the center of which is a stud 76 projecting a slight distance upwardly from the end wall 66 and on which is supported a hexagonal nut 77 which is non-rotatably received in the pocket 75, with opposed sides thereof closely fitted in the grooves 74, as can best be seen in FIG. 10. The retaining standoff 71 is so positioned that, when the nut 77 is received in the pocket 75 it is coaxial with one of the holes 69 in the cylindrical wall 68.

Figure 12:
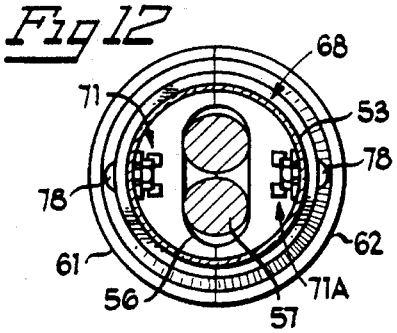
FIG. 12 is a view in horizontal section taken along the line 12—12 in FIG. 7.

In use, when the rear and front parts 61 and 62 have been disposed in their assembled condition, the lower end of the tube 53 is telescopically received in the coupling structures 70 and 70A, between the cylindrical wall 68 and the outer posts 72 (see FIGS. 7 and 12), so that the holes 55 in the tube 53 are, respectively, coaxial with the holes 69 in the cylindrical wall 68. It will be appreciated that the tube 53 then cooperates with the coupling structures 70 and 70A to hold together the rear and front parts 61 and 62 at the upper end of the base 52. Screws 78 are then respectively received through the aligned holes in the cylindrical wall 68 and the tube 53 and threadedly engaged respectively with the nuts 77 to fixedly secure the assembly together.

The lamp 50 also includes a cap assembly 80 for closing the tube 53 at its upper end. The cap assembly 80 includes a circular end plate 81 having an outer diameter substantially equal to that of the tube 53 so as to be received against the upper end thereof, the end plate 81 having an upwardly projecting cylindrical socket 82 centrally thereof. A cylindrical cushion 83, formed of a body of foamed rubber or the like, is snugly fitted in the upper end of the tube 53, the cushion 83 preferably having a rectangular hole 84 formed therethrough for seating the upper end of the fluorescent bulb 57. If desired, the cushion 83 may be fixedly secured, as by adhesive, to the underside of the end plate 81. The cap assembly 80 also includes a dome-like cover 85 having a depending cylindrical side wall 86 adapted to be telescopically received over the upper end of the tube 53, and having formed therein an annular shoulder 87 for seating the end plate 81. Formed centrally of the cover 85 is a cylindrical hub 88 having a cylindrical bore 89 formed therethrough coaxially with the socket 82 in the end plate 81. A hook 90 has the straight end thereof received through the bore 89 and seated in the socket 82, the straight hook end being provided with a C-clip 91 which is disposed between the socket 82 and the hub 88. The side wall 86 has radial openings formed therethrough, respectively disposed for coaxial alignment with the holes 54 in the tube 53 for respectively receiving therethrough fasteners 92 to securely fasten the cap assembly 80 to the upper end of the tube 53. The fasteners 92 may be push rivets or other pin-like plastic members with flexible shanks expansible inside the tube 53 to lock in place.

When thus assembled, it will be appreciated that the cushion 83 is firmly held against the upper end of the fluorescent tube 57 to cushion it against shock, vibration and the like. The hook 90 is retained in place by the clip 91, while being freely rotatable about the axis of the tube 53.

It can be seen that the lamp 50 has the same ergonomic design as the lamp 10, described above, and it will be appreciated that it utilizes the same ballast circuit 40 and push button switch 42 and functions electrically the same as the lamp 10. However, the lamp 50 has the advantage that access can be had to the fluorescent bulb 57, for replacement or the like, without the necessity of disassembling the base 52. More specifically, if access to the bulb is required, it is only necessary to remove the tube 53 from the base 52 by removing the screws 78. Additionally, the lamp 50 provides a simple and effective means for holding together the base parts at their upper end and also an effective cushioning of the fluorescent bulb 57, so as to prevent damage from accidental shock or the like.

From the foregoing, it can be seen that there has been provided an improved, portable, cordless, electric lamp which is of simple and economical construction and which provides an ergonomic design, a high efficiency light source, a convenient, detachable battery pack, a simple means for holding together a two-part base, which facilitates bulb replacement, and an effective cushioning of the bulb.

We claim:

1. A portable cordless electric lamp comprising: a base including first and second parts cooperating in an assembled condition to define a handle portion, an elongated cylindrical tube formed of a light transmitting material and having opposite ends, coupling structures respectively on said base parts, one end of said tube being received in both of said coupling structures when said base parts are in the assembled condition for holding said base parts in the assembled condition, each of said coupling structures including a part-cylindrical outer wall portion and retaining structure spaced a slight distance radially inwardly of said part-cylindrical wall portion, said part-cylindrical wall portions cooperating in the assembled condition of said parts to define a cylindrical wall, said one end of said tube being coaxially received between said cylindrical wall and said retaining structures, fastening structure securing said one end of said tube to each of said coupling structures, an electric bulb mounted on said base and disposed within said tube for emitting light therefrom, and a battery carried by said base and coupled to said bulb.

2. The lamp of claim 1, wherein said one end of said tube has a radial hole therethrough, said fastening structure including a screw extending through said hole and securing said tube to one of said coupling structures.

3. The lamp of claim 1, wherein said handle portion has a distal end remote from said coupling structure, and further comprising means securing said first and second parts together adjacent to the distal end of said handle portion.

4. The lamp of claim 1, wherein said battery comprises a rechargeable battery pack.

5. The lamp of claim 1, wherein said bulb comprises a fluorescent bulb.

6. The lamp of claim 1, and further comprising a cap closing said tube at an end opposite said one end, and a hook mounted on said cap for swiveling movement relative thereto.

7. A portable cordless electric lamp comprising: a base defining a handle portion, an elongated cylindrical tube formed of a light-transmitting material and having a first end and a second end, said first end of said tube being coupled to said base, an elongated electric bulb disposed within said tube and having a proximal end mounted on said base and a distal end disposed adjacent to said second end of said tube, a battery carried by said base and coupled to said bulb, shock absorbing means including a body of foam rubber disposed within said tube closing said second end of said tube and resiliently engaged with the distal end of said bulb for supporting and cushioning same, and a cap mounted on said tube and closing said second end thereof, said foam rubber body being carried by said cap, said cap including a first member seated against said second end of said tube, and a second member having a cylindrical wall telescopically overlapping said second end of said tube and cooperating therewith to retain said first member in place.

8. The lamp of claim 7, wherein said body of foam rubber is cylindrical in shape having a central opening therein.

9. The lamp of claim 7, and further comprising fastening means for fixedly securing said second member to said tube.

10. The lamp of claim 7, and further comprising a hook carried by said cap for swiveling movement relative thereto.

11. A portable cordless electric lamp comprising: a base including first and second parts cooperating in an assembled condition to define a handle portion, an elongated cylindrical tube formed of a light-transmitting material and having a first end and a second end, coupling structures respectively on said base parts, said first end of said tube being received in both of said coupling structures when said base parts are in the assembled condition for holding said base parts in the assembled condition, each of said coupling structures including a part-cylindrical outer wall portion and retaining structure spaced a slight distance radially inwardly of said part-cylindrical wall portion, said part-cylindrical wall portions cooperating in the assembled condition of said parts to define a cylindrical wall, said one end of said tube being coaxially received between said cylindrical wall and said retaining structures, fastening structure securing said first end of said tube to each of said coupling structures, an elongated electric bulb disposed within said tube and having a proximal end mounted on said base and a distal end disposed adjacent to said second end of said tube, a battery carried by said base and coupled to said bulb, and shock absorbing means closing said second end of said tube and resiliently engaged with the distal end of said bulb for supporting and cushioning same.

12. The lamp of claim 11, wherein said bulb is a fluorescent bulb.

13. The lamp of claim 11, wherein said shock absorbing means includes a body of foam rubber disposed within said tube and resiliently engaging said bulb.

14. The lamp of claim 13, and further comprising a cap mounted on said tube and closing said second end thereof, said foam rubber body being carried by said cap.

15. The lamp of claim 14, and further comprising means fixedly securing said cap to said tube, and a hook carried by said cap for swiveling movement relative thereto.

* * * * *